US008528492B2

(12) United States Patent
Morris

(10) Patent No.: US 8,528,492 B2
(45) Date of Patent: Sep. 10, 2013

(54) METHOD OF CONTROLLING THE SIZE OF A FABRIC OF A GARMENT

(75) Inventor: Paul Morris, Bradford (GB)

(73) Assignee: Talon Technologies, Inc., Woodland Hills, CA (US)

( * ) Notice: Subject to any disclaimer, the term of this patent is extended or adjusted under 35 U.S.C. 154(b) by 735 days.

(21) Appl. No.: 12/528,846

(22) PCT Filed: Feb. 26, 2008

(86) PCT No.: PCT/GB2008/000656

§ 371 (c)(1),
(2), (4) Date: Jan. 5, 2010

(87) PCT Pub. No.: WO2008/104767

PCT Pub. Date: Sep. 4, 2008

(65) Prior Publication Data

US 2010/0101001 A1 Apr. 29, 2010

(30) Foreign Application Priority Data

Feb. 27, 2007 (GB) ..... 0703726.0

(51) Int. Cl.
*D05B 35/06* (2006.01)
*D05B 35/02* (2006.01)

(52) U.S. Cl.
USPC ..... 112/475.09

(58) Field of Classification Search
USPC ..... 112/475.09, 475.17, 475.14; 2/236, 2/237, 271
See application file for complete search history.

(56) References Cited

U.S. PATENT DOCUMENTS

| | | | | | |
|---|---|---|---|---|---|
| 2,492,097 | A | * | 12/1949 | Katz | 2/90 |
| 2,539,714 | A | * | 1/1951 | Young et al. | 38/66 |
| 2,994,091 | A | * | 8/1961 | Aftergood, Jr. | 2/243.1 |
| 4,466,137 | A | * | 8/1984 | Carnaghi | 2/237 |
| 5,168,581 | A | | 12/1992 | Garcia et al. | |
| 5,375,266 | A | * | 12/1994 | Crisco | 2/243.1 |
| 5,457,854 | A | * | 10/1995 | Easom | 24/300 |
| 2008/0264335 | A1 | | 10/2008 | Roup | |
| 2008/0268157 | A1 | | 10/2008 | Roup | |

FOREIGN PATENT DOCUMENTS

| | | | |
|---|---|---|---|
| CH | 327254 | A | 1/1958 |
| GB | 783726 | A | 9/1957 |
| WO | WO 03/035959 | * | 5/2003 |
| WO | WO 03/035959 | A | 5/2003 |

* cited by examiner

*Primary Examiner* — Ismael Izaguirre
(74) *Attorney, Agent, or Firm* — Brian Siritzky

(57) ABSTRACT

A method for controlling the size of a fabric of a garment includes providing an extensible garment fabric and attaching a relatively inextensible tape or cord proximate to an edge of the extensible garment fabric with the tape or cord made from a material which can be eliminated or made extensible during subsequent processing.

28 Claims, 2 Drawing Sheets

METHOD OF CONTROLLING THE SIZE OF A FABRIC OF A GARMENT

The present invention relates to a method of controlling the size of a fabric of a garment and also to a garment manufactured by such a method. More particularly, but not exclusively, the present invention relates to a method whereby an extensible fabric has an edge fixed in length by a relatively inextensible cord or tape, the cord or tape being adapted to be made extensible or eliminated by subsequent processing.

It is known how to manufacture waistbands with little or no shrinkage (for example as disclosed in European patent publication No 0705336). This is useful to garment manufacturers because if the waistband is correctly dimensioned before washing it will be correctly dimensioned after washing.

During manufacture of a garment a garment fabric is attached to a garment waistband. An extensible waistband can however become distorted during the manufacture of a garment using extensible garment fabric. During attachment of the extensible garment fabric to the waistband forces can be inadvertently applied to the garment fabric causing it to extend. After attachment to the waistband the garment fabric relaxes distorting the waistband.

Addition of an inextensible stabilising cord to the garment fabric to prevent stretch is unsuitable as this prevents the garment fabric and the attached waistband of the resulting garment from expanding.

The present invention seeks to overcome this problem.

Accordingly, in a first aspect, the present invention provides a method for controlling the size of a fabric of a garment comprising providing an extensible garment fabric;

attaching a relatively inextensible tape or cord proximate to an edge of the extensible garment fabric;

characterised in that the tape or cord is made from a material which can be eliminated or made extensible during subsequent processing.

Preferably, the tape or cord is attached to the extensible garment fabric by simultaneously passing them through a sewing machine.

Preferably the tape or cord is made from a material which is water soluble and will dissolve during garment washing.

Alternatively, the tape or cord is made of a heat activated or steam activated material which becomes extensible on activation.

The water soluble fibres can be polyvinyl alcohol (PVA) fibres.

The fibres can be low melt polyamide fibres.

Preferably, the extensible fabric is cut on a bias to the tape or cord.

The extensible fabric can comprise inextensible fabric fibres, the fabric being extensible along the line of the tape or cord by means of the fabric being on a bias to the tape or cord.

The garment fabric can be partially extended before attachment of the cord or tape.

Preferably, the method further comprises the steps of providing an extensible waistband;

connecting the edge of the sewn fabric fixed by the cord or tape to the extensible waistband; and, subsequent processing of the resulting garment to remove the cord or tape.

In a further aspect of the invention there is provided an extensible garment fabric, the fabric having an edge fixed in length by a relatively inextensible tape or cord, the tape or cord being made from a material which can be eliminated or made extensible by subsequent processing.

In a further aspect of the invention there is provided a garment comprising an extensible garment fabric having an edge fixed in length by a relatively inextensible tape or cord, the tape or cord being made from a material which can be eliminated or made extensible by subsequent processing; and, an extensible waistband;

the edge of the garment fabric fixed by the tape or cord being attached to the waistband.

The present invention will now be described by way of example only and not in any limitative sense with reference to the accompanying drawings in which FIG. 1 shows an extensible fabric with an edge slightly stretched during manufacture;

Figure 1:
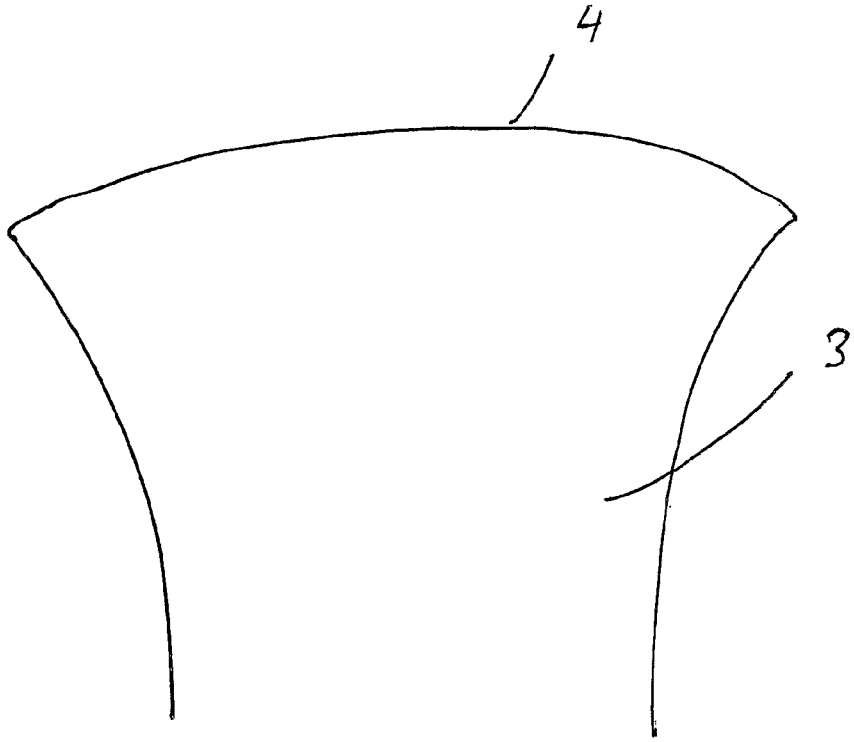

A conventional garment 1 comprising a waistband 2 is typically manufactured by connection of a garment fabric 3 to a garment waistband 2. This is typically achieved by passing the waistband 2 and garment fabric 3 simultaneously through a sewing machine. As the garment fabric 3 is passed though the sewing machine longitudinal forces can inadvertently be applied along the edge 4 of the garment fabric 3. This can result in a slight extension of the garment fabric 3 as shown in FIG. 1.

Figure 2:
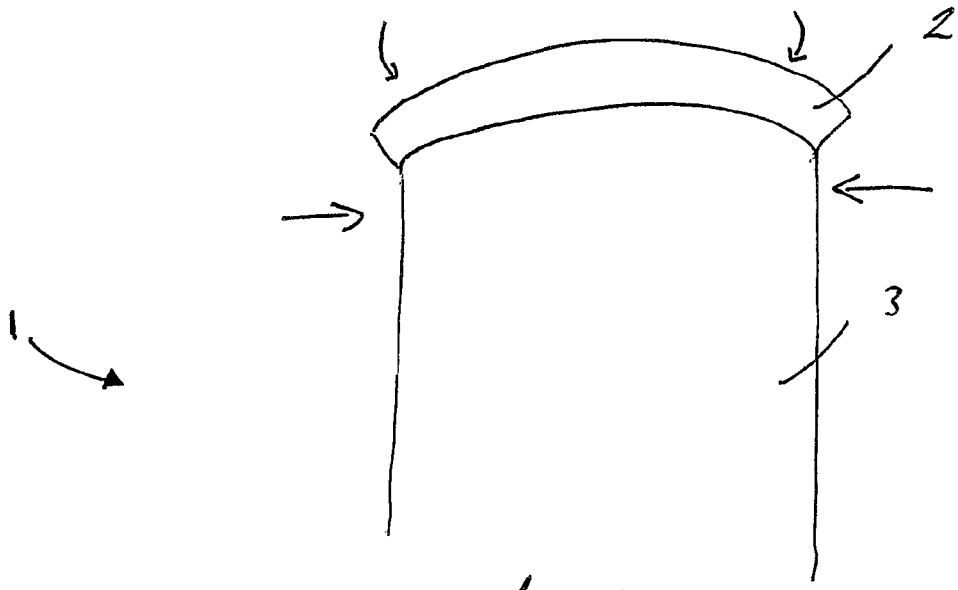
FIG. 2 shows the garment fabric of FIG. 1 connected to a waistband.

After sewing together the garment fabric 3 relaxes to its natural length. This distorts the waistband 2 as shown in FIG. 2. This can be undesirable to garment manufacturers.

Figure 3:
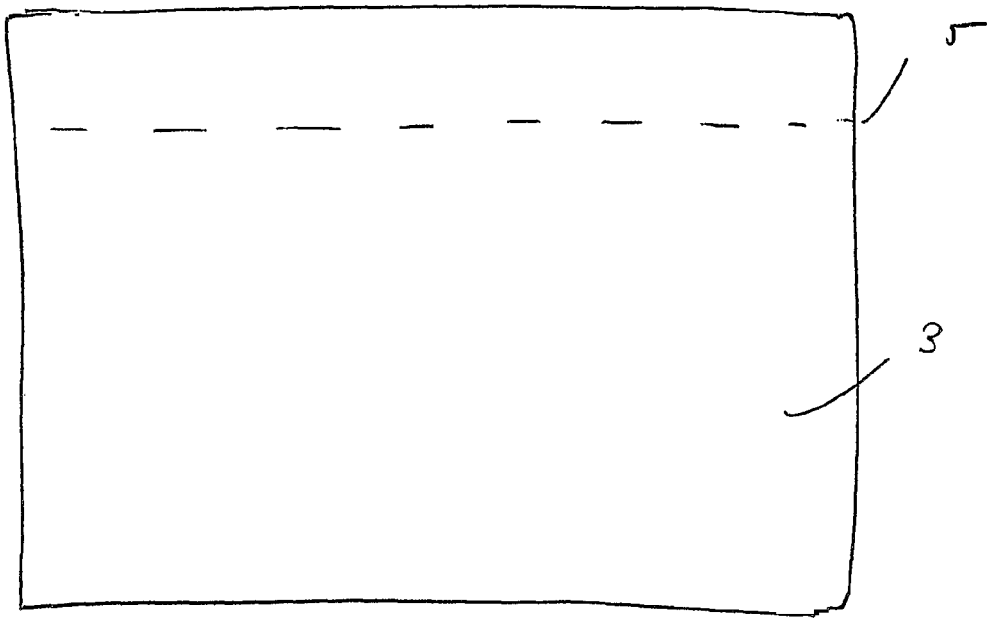
FIG. 3 shows an extensible fabric with one edge fixed by an inextensible cord or tape; and, FIG. 4 shows the extensible fabric of FIG. 3 connected to an extensible waistband.
Figure 4:
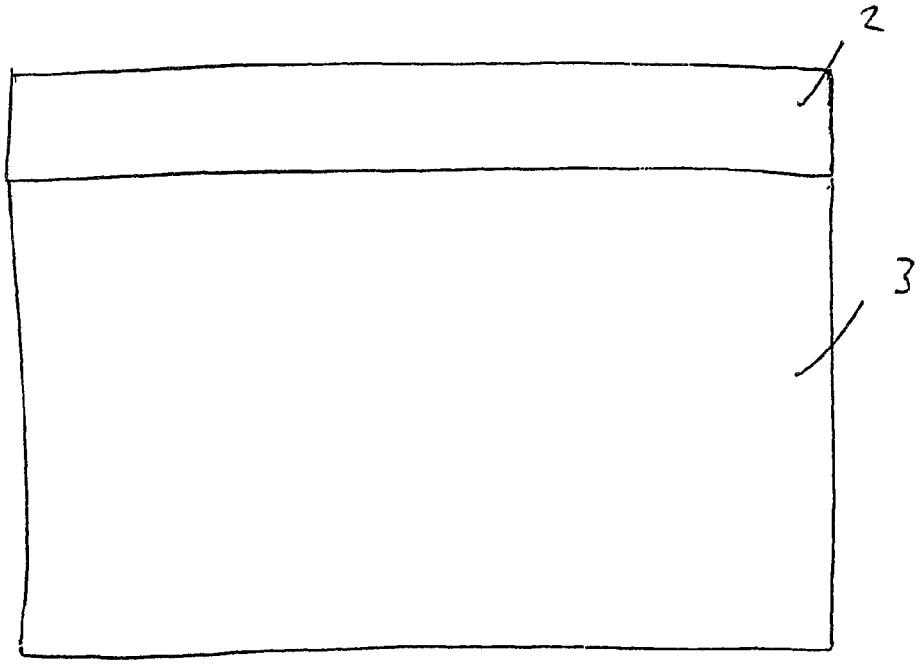

Turning now to FIGS. 3 and 4, an embodiment of the method according to the invention is illustrated. Firstly, an inextensible cord or tape 5 is attached to the edge 4 of the garment fabric. This is typically achieved by passing the fabric 3 and cord/tape 5 simultaneously through a sewing machine.

After attachment of the cord/tape 5 the garment fabric 3 is connected to an extensible waistband 2. The cord/tape 5 acts as a work aid preventing extension of the garment fabric 3 during connection.

After connection of the garment fabric 3 and waistband 2 to produce a garment 1 the resulting garment 1 is further processed to remove the cord or tape 5 as shown in FIG. 4. The waistband 2 of the resulting garment 1 and associated garment fabric 3 is then free to expand during wear as required.

In this embodiment of the invention the cord/tape 5 is an inextensible water soluble material such as polyvinyl alcohol (PVA) fibres. The PVA fibres dissolve the first time the garment 1 is washed so allowing the waistband 2 and garment fabric 3 to expand.

In an alternative embodiment of the invention the cord/tape 5 is made from fibres which are activated by heat or steam and become extensible on activation, for example low melt polyamide fibres. After manufacture of the garment 1, the garment 1 can be pressed to activate the fibres and make the garment 1 extensible.

The garment fabric 3 can be made from extensible fabric fibres. Alternatively, the fabric 3 can be made from inextensible fabric fibres. In this case the fabric 3 is cut on a bias to the tape or cord 5 and to the waistband 2 so allowing the fabric 3 to expand along the length of the waistband 2.

The tape or cord 5 is typically attached to the garment fabric 3 with the garment fabric 3 in its neutral (i.e. neither extended nor compressed) state so as to keep the change in length of the edge 4 of the garment fabric 3 to a minimum when the garment fabric 3 relaxes. This is particularly useful when the extensible waistband 2 does not shrink when washed.

The method is also suitable however for use with extensible waistbands 2 which shrink when washed. During the manufacture of garments 1 including such waistbands 2 the garment fabric 3 is extended slightly before the cord or tape 5 is applied. The garment fabric 3 is then attached to the waistband 2.

During subsequent processing the garment fabric 3 relaxes. If the fabric 3 has been extended by the correct amount, the relaxation will compensate for the shrinkage in the waistband 2 so resulting in an undistorted garment 1.

The invention claimed is:

1. A method for controlling the size of a fabric of a garment, comprising:

attaching a relatively inextensible tape or cord proximate to an edge of an extensible garment fabric with the relatively inextensible tape or cord being made from a material that is able to be eliminated or made extensible during subsequent processing, wherein said relatively inextensible tape or cord is made from a material that is water soluble and will dissolve during a washing of the extensible garment fabric, and wherein said material that is water soluble includes water soluble fibers that are polyvinyl alcohol fibers, and wherein said material that is water soluble includes water soluble fibers that are made of a low-melt polyamide.

2. The method for controlling the size of a fabric of a garment according to claim 1, wherein said relatively inextensible tape or cord is attached to the extensible garment fabric by simultaneously passing through a sewing machine.

3. The method for controlling the size of a fabric of a garment according to claim 1, wherein said relatively inextensible tape or cord is made of a heat activated material that becomes extensible upon activation via heat.

4. The method for controlling the size of a fabric of a garment according to claim 1, wherein said relatively inextensible tape or cord is made of a steam activated material that becomes extensible upon activation via application of steam thereto.

5. The method for controlling the size of a fabric of a garment according to claim 1, further comprising the step of:

cutting the extensible garment fabric on a bias to the relatively inextensible tape or cord.

6. The method for controlling the size of a fabric of a garment according to claim 5, wherein the extensible garment fabric includes inextensible fabric fibers, the extensible garment fabric being extensible along a line of the relatively inextensible tape or cord via the extensible garment fabric being on a bias to relatively inextensible tape or cord.

7. The method for controlling the size of a fabric of a garment according to claim 1, further comprising the step of:

partially extending the extensible garment fabric before attaching the relatively inextensible tape or cord.

8. The method for controlling the size of a fabric of a garment according to claim 1, further comprising:

connecting an edge of the extensible garment fabric fixed by the relatively inextensible tape or cord to an extensible waistband to obtain a resulting combined garment; and, subsequently processing the resulting combined garment for removing the relatively inextensible tape or cord.

9. A method for controlling the size of a fabric of a garment, the method comprising:

attaching a relatively inextensible tape or cord proximate to an edge of an extensible garment fabric with the relatively inextensible tape or cord being made from a material that is able to be eliminated or made extensible during subsequent processing; and cutting the extensible garment fabric on a bias to the relatively inextensible tape or cord.

10. The method for controlling the size of a fabric of a garment according to claim 9, wherein said relatively inextensible tape or cord is attached to the extensible garment fabric by simultaneously passing through a sewing machine.

11. The method for controlling the size of a fabric of a garment according to claim 9, wherein said relatively inextensible tape or cord is made from a material that is water soluble and will dissolve during a washing of the extensible garment fabric.

12. The method for controlling the size of a fabric of a garment according to claim 11, wherein said material that is water soluble includes water soluble fibers that are polyvinyl alcohol fibers.

13. The method for controlling the size of a fabric of a garment according to claim 11, wherein said material that is water soluble includes water soluble fibers that are made of a low-melt polyamide.

14. The method for controlling the size of a fabric of a garment according to claim 9, wherein said relatively inextensible tape or cord is made of a heat activated material that becomes extensible upon activation via heat.

15. The method for controlling the size of a fabric of a garment according to claim 9, wherein said relatively inextensible tape or cord is made of a steam activated material that becomes extensible upon activation via application of steam thereto.

16. The method for controlling the size of a fabric of a garment according to claim 9, wherein the extensible garment fabric includes inextensible fabric fibers, the extensible garment fabric being extensible along a line of the relatively inextensible tape or cord via the extensible garment fabric being on a bias to relatively inextensible tape or cord.

17. The method for controlling the size of a fabric of a garment according to claim 9, further comprising:

partially extending the extensible garment fabric before attaching the relatively inextensible tape or cord.

18. The method for controlling the size of a fabric of a garment according to claim 9, further comprising:

connecting an edge of the extensible garment fabric fixed by the relatively inextensible tape or cord to an extensible waistband to obtain a resulting combined garment; and, subsequently processing the resulting combined garment for removing the relatively inextensible tape or cord.

19. A method for controlling the size of a fabric of a garment comprising:

attaching a relatively inextensible tape or cord proximate to an edge of an extensible garment fabric with the relatively inextensible tape or cord being made from a material that is able to be eliminated or made extensible during subsequent processing;

connecting an edge of the extensible garment fabric fixed by the relatively inextensible tape or cord to an extensible waistband to obtain a resulting combined garment; and, subsequently processing the resulting combined garment for removing the relatively inextensible tape or cord.

20. The method for controlling the size of a fabric of a garment according to claim 19, wherein said relatively inextensible tape or cord is attached to the extensible garment fabric by simultaneously passing through a sewing machine.

21. The method for controlling the size of a fabric of a garment according to claim 19, wherein said relatively inextensible tape or cord is made from a material that is water soluble and will dissolve during a washing of the extensible garment fabric.

22. The method for controlling the size of a fabric of a garment according to claim 21, wherein said material that is water soluble includes water soluble fibers that are polyvinyl alcohol fibers.

23. The method for controlling the size of a fabric of a garment according to claim 21, wherein said material that is water soluble includes water soluble fibers that are made of a low-melt polyamide.

24. The method for controlling the size of a fabric of a garment according to claim 19, wherein said relatively inextensible tape or cord is made of a heat activated material that becomes extensible upon activation via heat.

25. The method for controlling the size of a fabric of a garment according to claim 19, wherein said relatively inextensible tape or cord is made of a steam activated material that becomes extensible upon activation via application of steam thereto.

26. The method for controlling the size of a fabric of a garment according to claim 19, further comprising:

cutting the extensible garment fabric on a bias to the relatively inextensible tape or cord.

27. The method for controlling the size of a fabric of a garment according to claim 26, wherein the extensible garment fabric includes inextensible fabric fibers, the extensible garment fabric being extensible along a line of the relatively inextensible tape or cord via the extensible garment fabric being on a bias to relatively inextensible tape or cord.

28. The method for controlling the size of a fabric of a garment according to claim 19, further comprising:

partially extending the extensible garment fabric before attaching the relatively inextensible tape or cord.

* * * * *